US008027603B2

(12) United States Patent
Fromm

(10) Patent No.: US 8,027,603 B2
(45) Date of Patent: Sep. 27, 2011

(54) FUSER APPARATUS HAVING FUSER CLEANER WEB AND CORRESPONDING METHODS

(75) Inventor: Paul M. Fromm, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 690 days.

(21) Appl. No.: 12/127,166

(22) Filed: May 27, 2008

(65) Prior Publication Data

US 2009/0297186 A1 Dec. 3, 2009

(51) Int. Cl.
*G03G 15/20* (2006.01)

(52) U.S. Cl. ..... 399/45; 399/327

(58) Field of Classification Search ..... 399/45, 399/327

See application file for complete search history.

(56) References Cited

U.S. PATENT DOCUMENTS

| | | | | |
|---|---|---|---|---|
| 5,749,038 | A | 5/1998 | Fromm et al. | |
| 6,505,832 | B2 | 1/2003 | Moore et al. | |
| 6,532,353 | B1 * | 3/2003 | Orchard et al. | 399/327 |
| 6,771,925 | B2 * | 8/2004 | Satoh | 399/327 |
| 6,876,832 | B2 | 4/2005 | Pirwitz et al. | |

* cited by examiner

*Primary Examiner* — William J Royer
(74) *Attorney, Agent, or Firm* — Richard A. Castellano; Prass LLP

(57) ABSTRACT

Disclosed are methods of controlling a speed of a fuser cleaner web in a fuser apparatus, and the corresponding fuser apparatus. The method utilizes a fuser apparatus having a fuser roll and a web nip roll, the fuser cleaner web for cleaning the fuser roll and being disposed between the fuser roll and the web nip roll. The method determines a property of a media to be fused in the fuser apparatus, and controls a speed of the fuser cleaner web based on the determined property of the media.

19 Claims, 4 Drawing Sheets

FUSER APPARATUS HAVING FUSER CLEANER WEB AND CORRESPONDING METHODS

BACKGROUND

Disclosed are fuser apparatus having a fuser cleaner web and corresponding methods.

In a typical electrophotographic or electrostatographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited as latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed rolls at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a conventional two roll fuser, one of the rolls is typically provided with a layer or layers that are deformable by a harder opposing roller when the two rollers are pressure engaged.

In typical fusing systems, the fuser roll can be cleaned by a web. The web provides a textured surface for removing particles of toner that remain on the fuser roll after the substrate, e.g., paper with the toner image has passed through the fuser. The web may be drawn from a replaceable supply roll and be moved at a relatively slow rate relative to the movement of the fuser roll. The motion of the fuser roll relative to the web causes the fuser roll to rub against a small area of the web. Because the web is moving slower than the fuser roll friction of the web to the fuser roll surface causes a supply of clean web at a reasonable rate to clean toner from the fuser roll. The web is typically run at a constant speed high enough to clean the fuser roll.

SUMMARY

According to aspects of the embodiments, there is provided methods of controlling a speed of a fuser cleaner web in a fuser apparatus, and the corresponding fuser apparatus. The method utilizes a fuser apparatus having a fuser roll and a web nip roll, the fuser cleaner web for cleaning the fuser roll and being disposed between the fuser roll and the web nip roll. The method determines a property of a media to be fused in the fuser apparatus, and controls a speed of the fuser cleaner web based on the determined property of the media.

DETAILED DESCRIPTION

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The embodiments control a speed of a fuser cleaner web in a fuser apparatus based on properties of media to be fused in the fuser apparatus. By controlling the speed of the fuser cleaner web, the embodiments are able to slow the speed of the fuser cleaner web for certain media, thus lengthening the life of the fuser cleaner web.

The embodiments include a method of controlling a speed of a fuser cleaner web in a fuser apparatus, the fuser apparatus having a fuser roll and a web nip roll, the fuser cleaner web for cleaning the fuser roll and being disposed between the fuser roll and the web nip roll. The method includes determining a property of a media to be fused in the fuser apparatus, and controlling a speed of the fuser cleaner web based on the determined property of the media.

The embodiments further include a fuser apparatus, that includes a fuser roll, a web nip roll, and a fuser cleaner web disposed between the fuser roll and the web nip roll, the fuser cleaner web for cleaning the fuser roll, wherein a speed of the fuser cleaner web is controlled based on a determined property of a media to be fused in the fuser apparatus.

The embodiments further include a fuser apparatus, that includes a fuser roll, a web nip roll, a fuser cleaner web disposed between the fuser roll and the web nip roll, a plurality of heat rolls disposed between the fuser roll and the fuser cleaner web, wherein the fuser cleaner web is for indirectly cleaning the fuser roll, wherein a speed of the fuser cleaner web is controlled based on a determined property of a media to be fused in the fuser apparatus.

Figure 1:
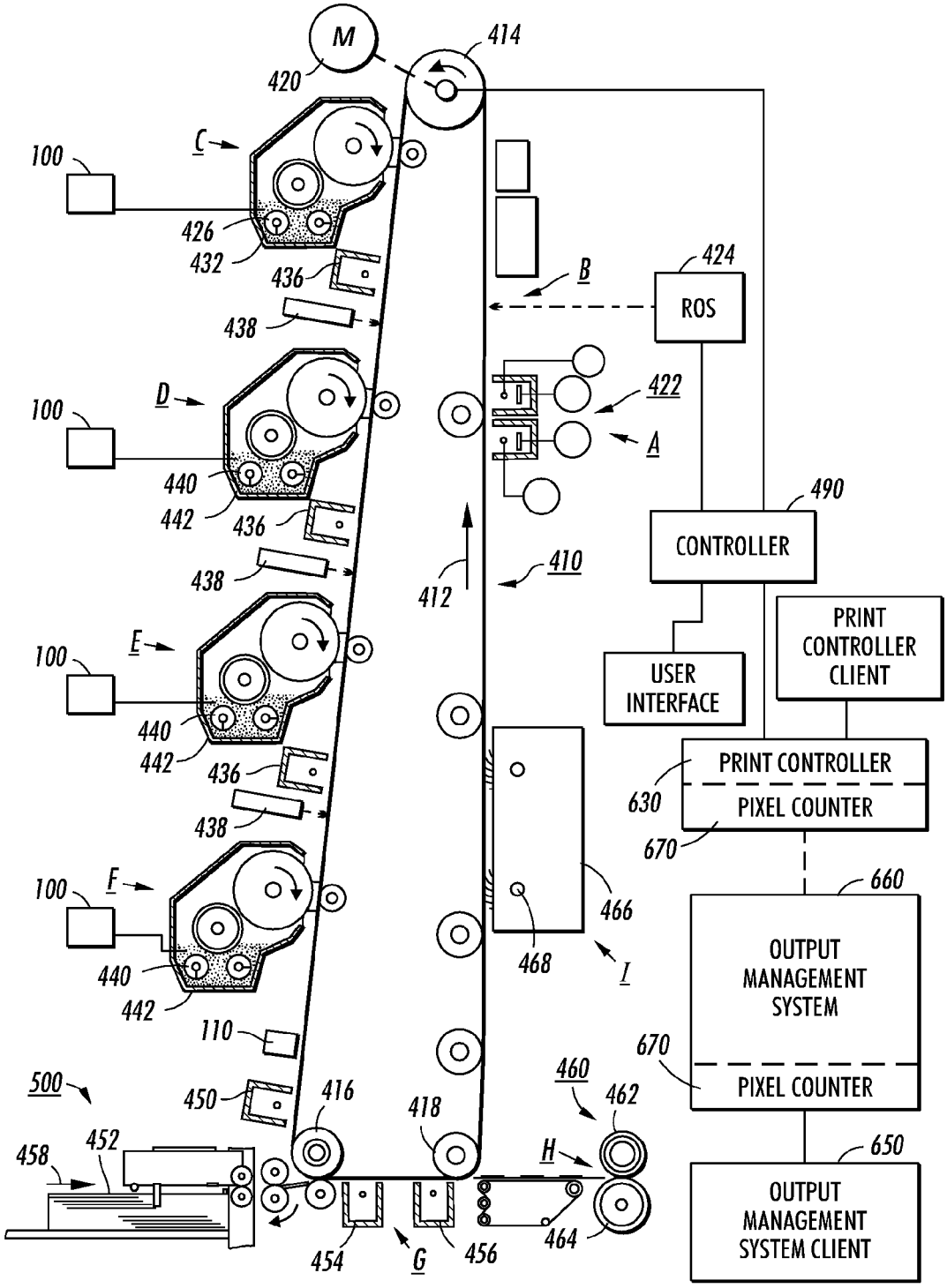
FIG. 1 illustrates a schematic view of a digital imaging system.

In as much as the art of electrophotographic printing is well known, the various processing stations employed in the FIG. 1 printing machine will be shown schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt 410 is entrained about a drive roller 414, tension roller 416 and fixed roller 418 and the drive roller 414 is operatively connected to a drive motor 420 for effecting movement of the belt 410 through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure containing developer material 426 and indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 100 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with the photoconductive surface of the photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as an endless fuser belt or endless fuser web (not the fuser cleaner web) around the fuser roller 462. In typical printing machines, this belt or web has been kept relatively short to minimize the size of the fuser assembly or cassette.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the fuser apparatus of the present disclosure therein. Not all of the elements discussed in conjunction with FIG. 1 are necessarily needed for effective use of the invention. Instead, these elements are described as a machine within which embodiments of the invention could operate.

Figure 2:
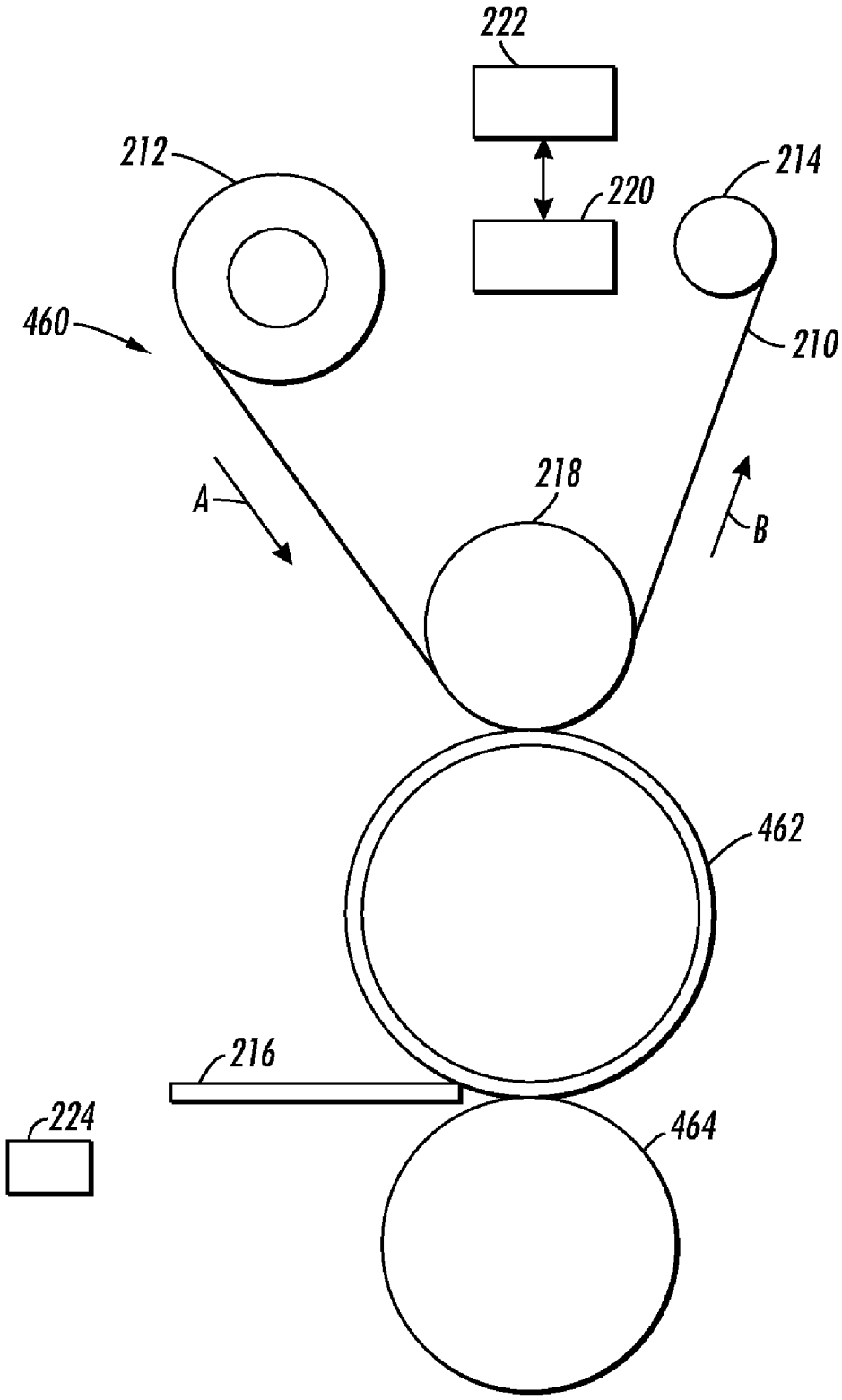
FIG. 2 illustrates a diagram of a fuser assembly.

FIG. 2 illustrates the fuser assembly 460 in greater detail. The fuser assembly 460 includes the fuser roll 462, the pressure roll 464, fuser cleaner web 210, web supply roll 212, web take up roll 214, web nip roll 218, motor 220, controller 222, and sensor 224. The motor 220 may be a motor such as a stepper motor, or synchronous motor, for example, although other types of motors may be used. The motor 220 may drive the take up roll 214, causing the fuser cleaner web 210 to move from the supply roll 212 in the direction of arrow A, to come into contact with the fuser roll 462, and then to move in the direction of arrow B onto the take up roll 214.

The speed and other aspects of motor 220 may be controlled by controller 222, which may be any type of controller. The controller 222 may be a part of the fuser assembly 460, although the controller 222 of the fuser assembly 460 could be omitted and another controller, such as controller 490 of FIG. 1, could be used in its place. During the fusing process, media sheet 216 may come into contact with fuser roll 462 to accomplish the fusing process. The controller may have an associated memory for storing data and programs, for example.

The embodiments control a speed of the fuser cleaner web 210 based on properties of the media 216. For example, the speed of the fuser cleaner web 210 may be controlled by a thickness of the media, a weight of the media, a roughness of the media, a coating type of the media, a manufacturer of the media, and the like, and combinations thereof. As an example, a roughness of the media 216 may be determined, and a speed of the fuser cleaner web 210 may be controlled based on the determined roughness.

The property of the media 216 may be determined in known ways, such as being measured by a device such as sensor 224. Further, properties of various media may be prestored in a memory, and the particular media may be determined by input from a user or be sensed by the apparatus, and a media property, such as roughness, may be looked up from the memory for the particular media. Further, embodiments may group media properties into ranges, and have a predetermined web speed for each range. For example, when the property is roughness (or smoothness), embodiments may use ranges of 0-50 Sheffield, 50-225 Sheffield, and 225 and higher Sheffield, with a different web fuser speed for each range. Fuser cleaner web speeds that may be used with these ranges could be 15 mm/Kp, 25 mm/Kp, and 45 mm/Kp, respectively, although any number of ranges and speed could be used.

Any number of such ranges could be used, and different ranges could be set for different properties. Additionally, more than one media property could be taken into account when determining a fuser cleaner web speed. Further, embodiments may store a "media library", which would list various media. The media library could have an associated speed stored for each different media, which could be predetermined based on media properties and stored in memory. When a particular media is being fused, the controller could look up the media and the corresponding fuser cleaner web speed to be used. Additionally, embodiments could include the media library and the ability to determine a media property from an unknown media, such as when determining a property with a device such as sensor 224.

By varying the speed of the fuser cleaner web, e.g., the fuser cleaner web 210, the embodiments can lengthen the life of the fuser cleaner web 210 by using a slower fuser cleaner web speed when appropriate. Media with different properties can cause more toner to be left on the fuser roll 462. For example, different roughness of media 216 can cause varying amount of toner to be left on the fuser roll 462. Thus, the speed of the fuser cleaner web 210 may be slowed down at times while still providing sufficient cleaning to the web fuser roll 462, lengthening the life of the fuser cleaner web 210.

Figure 3:
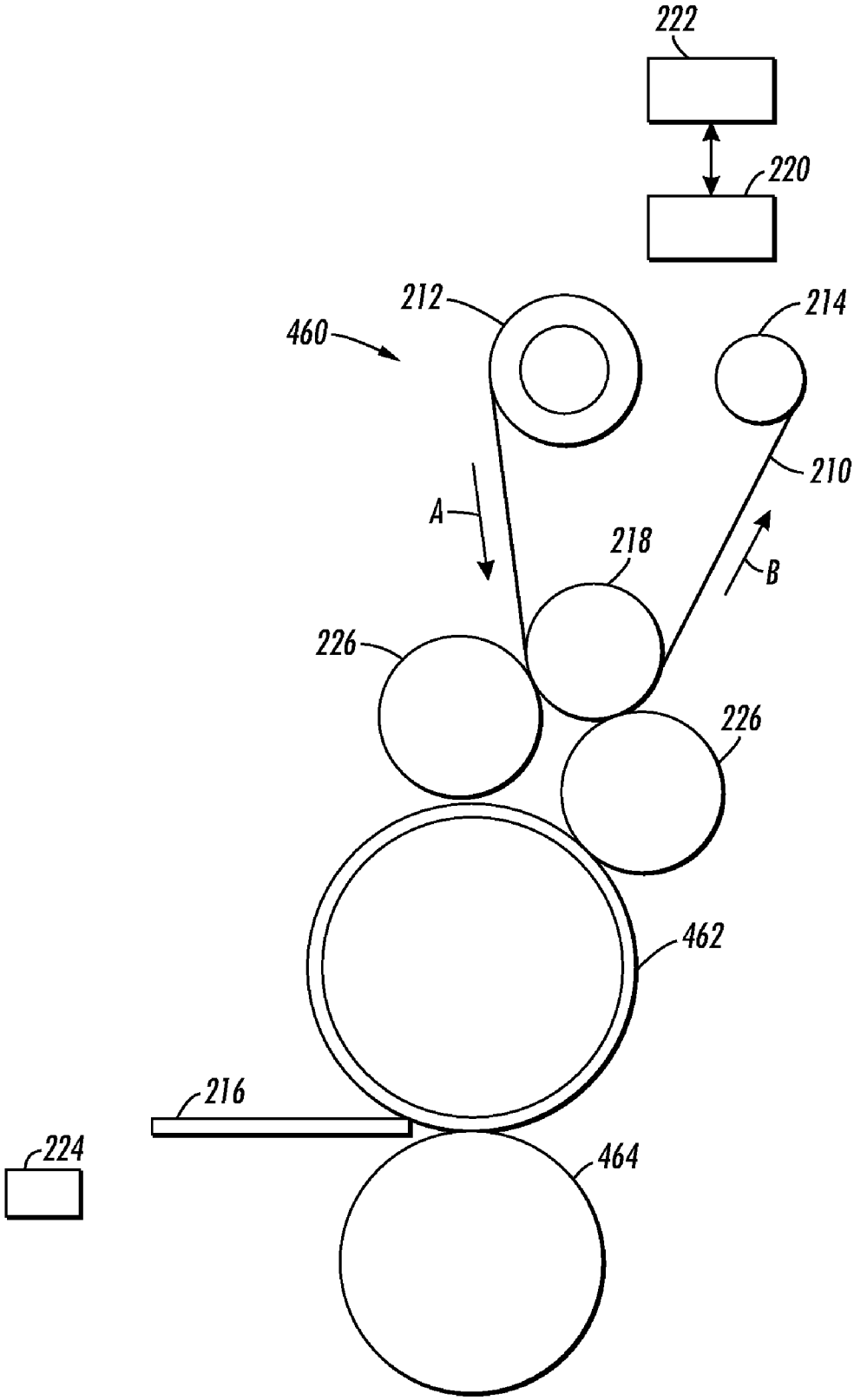
FIG. 3 illustrates a diagram of a fuser assembly.

FIG. 3 illustrates an embodiment of the fuser assembly 460 which in addition to the elements of FIG. 2, includes heat rolls 226 disposed between fuser cleaner web 210 and fuser roll 462. This embodiment uses the fuser cleaner web 210 to indirectly clean the fuser roll 462. In particular, the heat rolls 226 clean toner off the fuser roll 462, and the fuser cleaner web 210 then cleans toner from the heat rolls 226. The speed of the fuser cleaner web 210 is controlled based on a property of the media 216 being fused in the same manner as the FIG. 2 embodiment, to clean the fuser roll 462. Again, by controlling the speed of the fuser cleaner web 210, the embodiments are able to slow the speed when appropriate to lengthen the life of the fuser cleaner web 210.

The controller 222 may have instructions loaded via a computer readable medium. The embodiments may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

Figure 4:
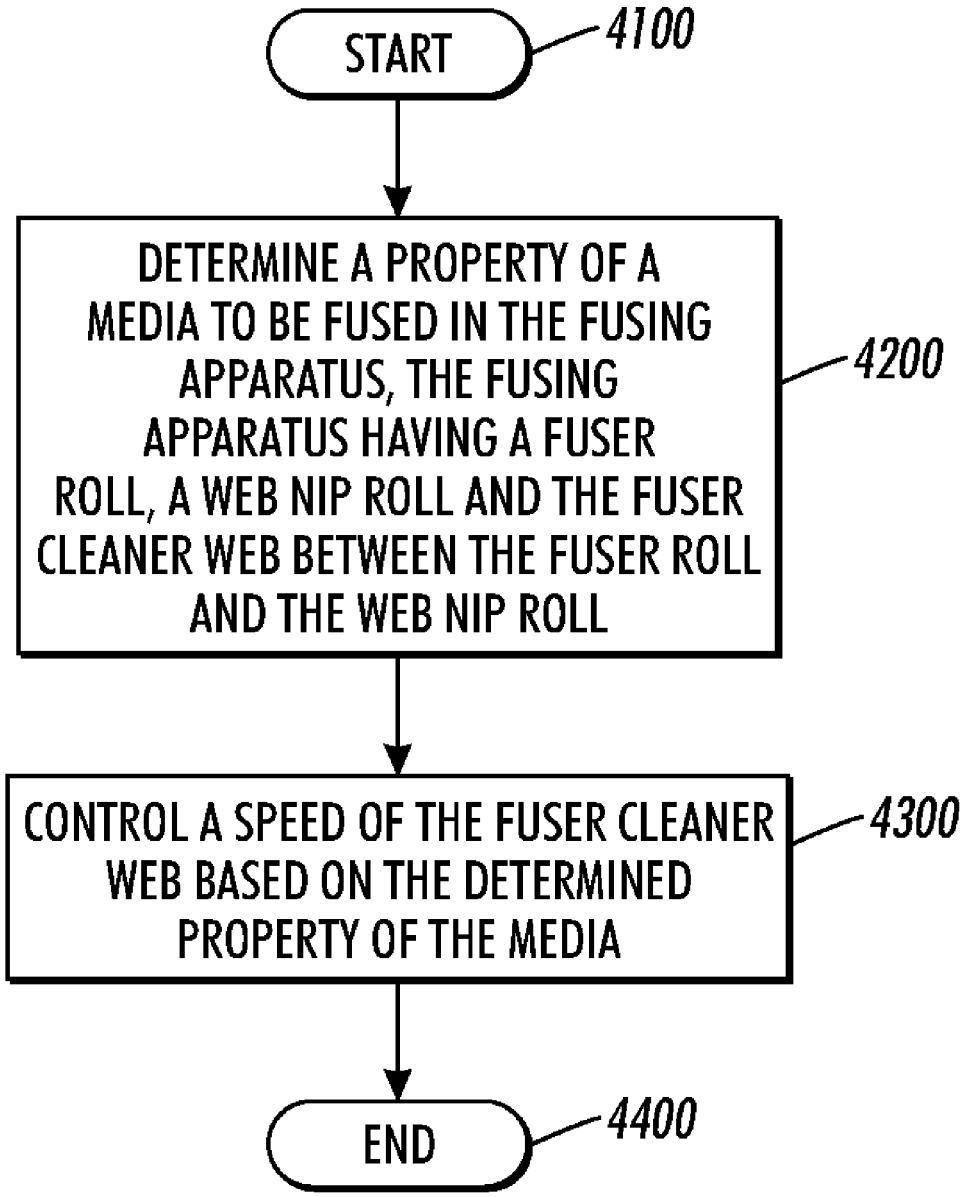
FIG. 4 illustrates a flowchart of a method for controlling a web speed in a fuser apparatus.

FIG. 4 illustrates a flowchart of a method for forming images on sheets in an electrophotographic apparatus. The method starts at 4100. At 4200, a property of a media to be fused in the fusing apparatus is determined, the fusing apparatus having a fuser roll, a web nip roll, and the fuser cleaner web between the fuser roll and the web nip roll.

At 4300, a speed of the fuser cleaner web is controlled based on the determined property of the media. At 4400, the method ends.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of controlling a speed of a fuser cleaner web in a fuser apparatus, the fuser apparatus having a fuser roll and a web nip roll, the fuser cleaner web for cleaning the fuser roll and being disposed between the fuser roll and the web nip roll, comprising:

determining a property of a media to be fused in the fuser apparatus; and controlling a speed of the fuser cleaner web based on the determined property of the media.

2. The method of claim 1, wherein the determined property of the media is one of a roughness of the media, a thickness of the media, a weight of the media, a coating type of the media, and a manufacturer of the media.

3. The method of claim 1, further comprising selecting the speed of the fuser cleaner web from a plurality of predetermined fuser cleaner web speeds based on the determined property of the media.

4. The method of claim 1, further comprising pre-assigning web speeds to each of a plurality of media properties.

5. The method of claim 1, further comprising predetermining a plurality of media property ranges, assigning a fuser cleaner web speed to each of the predetermined media property ranges, selecting one of the predetermined media property ranges corresponding to the determined media property, and selecting the fuser cleaner web speed assigned to the selected one of the media property ranges.

6. The method of claim 1, wherein a heater roll is disposed between the fuser roll and the fuser cleaner web, further comprising indirectly cleaning the fuser roll by controlling the fuser cleaner web speed based on the determined property of the media, wherein the heater roll cleans the fuser roll, and the fuser cleaner web cleans the heater roll to indirectly clean the fuser roll.

7. A fuser apparatus, comprising:

a fuser roll;

a web nip roll; and a fuser cleaner web disposed between the fuser roll and the web nip roll, the fuser cleaner web for cleaning the fuser roll, wherein a speed of the fuser cleaner web is controlled based on a determined property of a media to be fused in the fuser apparatus.

8. The fuser apparatus of claim 7, further comprising a motor connected to the fuser cleaner web and a controller connected to the motor, the controller for controlling the speed of the fuser cleaner web.

9. The fuser apparatus of claim 7, wherein the determined property of the media is one of a roughness of the media, a thickness of the media, a weight of the media, a coating type of the media, and a manufacturer of the media.

10. The fuser apparatus of claim 8, wherein the controller selects the speed of the fuser cleaner web from a plurality of predetermined fuser web speeds based on the determined property of the media.

11. The fuser apparatus of claim 7, wherein the web speeds are pre-assigned to each of a plurality of media properties.

12. The fuser apparatus of claim 7, further comprising a heater roll disposed between the fuser roll and the fuser cleaner web, wherein the fuser roll is indirectly cleaned by controlling the fuser cleaner web speed based on the determined property of the media, wherein the heater roll cleans the fuser roll, and the fuser cleaner web cleans the heater roll to indirectly clean the fuser roll.

13. An electrophotographic apparatus comprising the fuser apparatus of claim 7.

14. A fuser apparatus, comprising:

a fuser roll;

a web nip roll;

a fuser cleaner web disposed between the fuser roll and the web nip roll;

a plurality of heat rolls disposed between the fuser roll and the fuser cleaner web, wherein the fuser cleaner web is for indirectly cleaning the fuser roll, wherein a speed of the fuser cleaner web is controlled based on a determined property of a media to be fused in the fuser apparatus.

15. The fuser apparatus of claim 14, wherein the determined property of the media is one of a roughness of the media, a thickness of the media, a weight of the media, a coating type of the media, and a manufacturer of the media.

16. The fuser apparatus of claim 14, further comprising a motor connected to the fuser cleaner web and a controller connected to the motor, the controller for controlling the speed of the fuser cleaner web.

17. The fuser apparatus of claim 16, wherein the controller selects the speed of the fuser cleaner web from a plurality of predetermined fuser cleaner web speeds based on the determined property of the media.

18. The fuser apparatus of claim 14, wherein the fuser cleaner web speeds are pre-assigned to each of a plurality of media properties.

19. An electrophotographic apparatus comprising the fuser apparatus of claim 14.

* * * * *